US011254137B2

(12) United States Patent
Komuro et al.

(10) Patent No.: US 11,254,137 B2
(45) Date of Patent: Feb. 22, 2022

(54) RECORDING APPARATUS

(71) Applicant: SEIKO EPSON CORPORATION, Tokyo (JP)

(72) Inventors: Shintaro Komuro, Matsumoto (JP); Nobuhiko Shinozaki, Okaya (JP); Yuta Komatsu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 82 days.

(21) Appl. No.: 16/719,080

(22) Filed: Dec. 18, 2019

(65) Prior Publication Data

US 2020/0198356 A1 Jun. 25, 2020

(30) Foreign Application Priority Data

Dec. 21, 2018 (JP) ..... JP2018239661

(51) Int. Cl.
*B41J 2/175* (2006.01)
*B41J 29/02* (2006.01)
*B41J 29/13* (2006.01)

(52) U.S. Cl.
CPC ..... *B41J 2/17533* (2013.01); *B41J 2/1752* (2013.01); *B41J 2/17509* (2013.01); *B41J 29/02* (2013.01); *B41J 29/13* (2013.01)

(58) Field of Classification Search
CPC .. B41J 2/17533; B41J 2/1752; B41J 2/17509; B41J 29/13; B41J 29/02
See application file for complete search history.

(56) References Cited

U.S. PATENT DOCUMENTS

2012/0038719 A1* 2/2012 Shimizu ..... B41J 2/175 347/86
2012/0229546 A1* 9/2012 Okada ..... B41J 2/2142 347/14
2014/0063147 A1* 3/2014 Iwamuro ..... B41J 2/17543 347/86
2017/0087858 A1* 3/2017 Hayashi ..... B41J 2/17506
2018/0178567 A1 6/2018 Takabayashi et al.

FOREIGN PATENT DOCUMENTS

JP 2017065084 4/2017
JP 2018103526 7/2018

* cited by examiner

*Primary Examiner* — Yaovi M Ameh
(74) *Attorney, Agent, or Firm* — Workman Nydegger

(57) ABSTRACT

A recording apparatus including a recording unit that performs recording by discharging a liquid on a medium transported in a transport direction, a liquid storage portion that is disposed on an apparatus front side in an apparatus depth direction and that includes a liquid container that contains the liquid discharged from the recording unit, and a maintenance unit that performs maintenance on the recording unit. In the recording apparatus, the maintenance unit is provided in an end portion area on a first direction side in a width direction, the width direction being a direction intersecting the depth direction, and the liquid storage portion is provided in an end portion area on a second direction side, the second direction side being a side opposite the first direction side in the width direction, the liquid storage portion extending in the depth direction to an occupying area of the maintenance unit.

11 Claims, 14 Drawing Sheets

RECORDING APPARATUS

The present application is based on, and claims priority from JP Application Serial Number 2018-239661, filed Dec. 21, 2018, the disclosure of which is hereby incorporated by reference herein in its entirety.

BACKGROUND

1. Technical Field

The present disclosure relates to a recording apparatus including a liquid storage portion, which stores a liquid, on an apparatus front side.

2. Related Art

An ink jet printer is an example of a recording apparatus that performs recording on a medium by discharging a liquid. The ink jet printer includes a recording head that discharges ink that is an example of the liquid.

Furthermore, there is an ink jet printer that further includes an ink storage container, which stores ink, at a position distanced away from the recording head. In such a configuration, the ink storage container and the recording head are coupled to each other with an ink supply tube.

Regarding the position where the ink storage container is disposed, for example, JP-A-2017-065084 discloses a configuration in which ink tanks are provided on the right side of an apparatus front side. In the configuration described in JP-A-2017-065084, while the ink tanks are housed inside the housing constituting an outer shell of the apparatus, the portion where the ink tanks are housed is formed so as to protrude from a right lateral surface of an apparatus body.

Further increase in the volumes of the ink tanks is in need. Accordingly, as in the configuration described above in JP-A-2017-065084, the portion where the ink tanks are housed may be formed so as to protrude from the lateral side; however, in such a case, the protruded portion itself will become a space needed in installing the device. On the other hand, since the front surface side of the apparatus becomes a space where the recording sheet is discharged at least when the apparatus is used, if the portion where the ink tanks are housed is formed so as to protrude from the front surface of the apparatus, an increase in the installation space of the apparatus owing to the formation of the above portion can be prevented.

However, even in the above case, it is desirable that, in the portion where the ink tanks are housed, the amount of protrusion from the apparatus front surface is suppressed from the viewpoint of suppressing the packing size and from the viewpoint of maintaining the appearance of the apparatus.

SUMMARY

In order to overcome the above issue, a recording apparatus according to the present disclosure includes a recording unit that performs recording by discharging a liquid on a medium transported in a transport direction, a liquid storage portion that is disposed on an apparatus front side in an apparatus depth direction and that includes a liquid container that contains the liquid discharged from the recording unit, and a maintenance unit that performs maintenance on the recording unit. In the recording apparatus, the maintenance unit is provided in an end portion area on a first direction side in a width direction, the width direction being a direction intersecting the depth direction, and the liquid storage portion is provided in an end portion area on a second direction side, the second direction side being a side opposite the first direction side in the width direction, the liquid storage portion extending in the depth direction to an occupying area of the maintenance unit.

DESCRIPTION OF EXEMPLARY EMBODIMENTS

Figure 1:
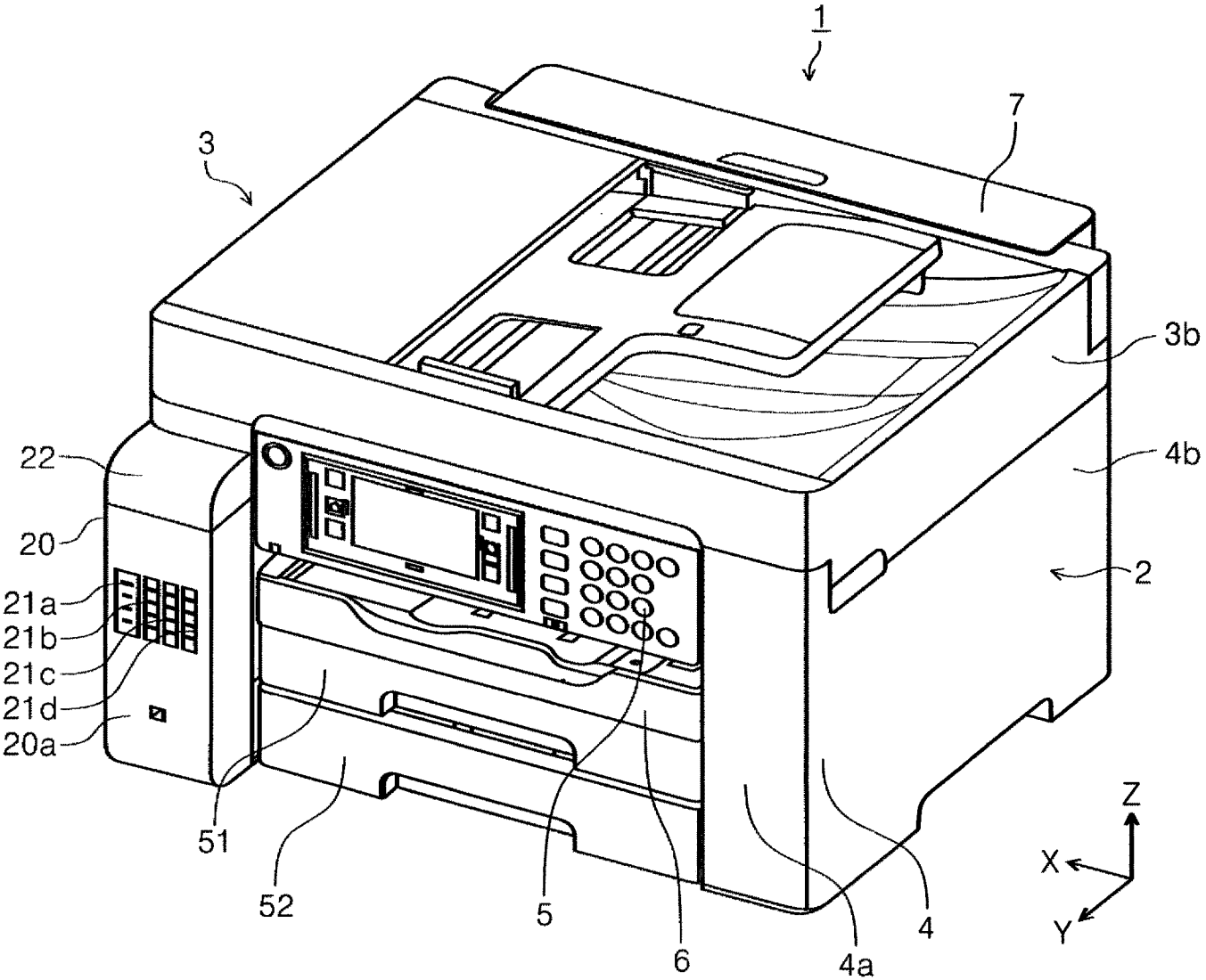
FIG. 1 is a perspective view of a printer according to a first exemplary embodiment.

Hereinafter, an outline of the present disclosure will be described.

A recording apparatus according to a first aspect includes a recording unit that performs recording by discharging a liquid on a medium transported in a transport direction, a liquid storage portion that is disposed on an apparatus front side in an apparatus depth direction and that includes a liquid container that contains the liquid discharged from the recording unit, and a maintenance unit that performs maintenance on the recording unit. In the recording apparatus, the maintenance unit is provided in an end portion area on a first direction side in a width direction, the width direction being a direction intersecting the depth direction, and the liquid storage portion is provided in an end portion area on a second direction side, the second direction side being a side opposite the first direction side in the width direction. The liquid storage portion extends in the depth direction to an occupying area of the maintenance unit.

According to the present aspect, the liquid storage portion that includes the liquid container in which the liquid is stored and that is disposed on the apparatus front side is, in the width direction that is a direction intersecting the apparatus depth direction, provided in the end portion area on the second direction side, which is opposite the end portion area on the first direction side which is where the maintenance unit that performs maintenance on the recording unit is provided; accordingly, interference between the liquid storage portion and the maintenance unit is avoided and the occupying area of the liquid storage portion can be extended in the apparatus depth direction. With the above, the protrusion amount of the liquid storage portion from the apparatus front surface can be suppressed while a sufficient volume of the liquid container is obtained.

A second aspect according to the first aspect may further include a pair of downstream rollers that are a pair of rollers first positioned, in the transport direction, downstream of a recording area where the recording unit performs recording, the pair of downstream rollers sending a medium, on which recording has been performed, downstream. In the second aspect, the liquid storage portion may extend in the depth direction to a position on a rear side of the apparatus with respect to the pair of downstream rollers.

According to the present aspect, since the liquid storage portion extends in the depth direction to the position on the rear side of the apparatus with respect to the pair of downstream rollers, the volume of the liquid container can be increased further.

In the third aspect according to the second aspect, the liquid storage portion may extend in the depth direction to where the recording unit is positioned.

According to the present aspect, since the liquid storage portion extends in the depth direction to the position where the recording unit is positioned, the volume of the liquid container can be increased further.

In a fourth aspect according to the second or third aspect, the liquid container may include a first liquid storage area and a second liquid storage area, a height of the second liquid storage area being lower than that of the first liquid storage area, and the second liquid storage area extending in the depth direction to the occupying area of the maintenance unit.

According to the present aspect, the liquid container includes the first liquid storage area and the second liquid storage area in which the height of the second liquid storage area is lower than that of the first liquid storage area and in which the second liquid storage area extends in the depth direction to the occupying area of the maintenance unit. By providing the second liquid storage area, it is easier to extend the liquid container rearwardly in the depth direction and the volume of the liquid container can be increased effectively.

A fifth aspect according to the fourth aspect may include a carriage that is provided with a recording head that constitutes the recording unit, the carriage configured to reciprocate in the width direction, and a portion of the second liquid storage area may be positioned below a reciprocating area of the carriage.

According to the present aspect, the carriage is configured to reciprocate in the width direction and a portion of the second liquid storage area is positioned below the reciprocating area of the carriage; accordingly, the dimension of the apparatus in the width direction can be suppressed.

A sixth aspect according to any one of the first to fifth aspects may include a housing that constitutes an outer shell of an apparatus body included in the recording unit. In the sixth aspect, the liquid storage portion may include a protruding portion that protrudes forwardly from a front surface of an end portion of the housing on the first direction side, and the liquid storage portion may be configured to, at an upper portion of the protruding portion, expose a filling port through which a liquid is filled into the liquid container.

According to the present aspect, since the filling port is configured to be exposed at the upper portion of the protruding portion, a refilling work of refilling the liquid into the liquid container through the filling port can be facilitated.

In a seventh aspect according to the sixth aspect, the liquid storage portion may include a plurality of the liquid containers aligned in the width direction, and each of the plurality of liquid containers may include the filling port.

An effect of either one of the first to fifth aspects can be obtained in the present aspect in which the liquid storage portion includes a plurality of the liquid containers aligned in the width direction, and in which each of the plurality of liquid containers includes the filling port.

In an eighth aspect according to the seventh aspect, one of the liquid container among the plurality of liquid containers may be a liquid container that stores black ink, and the liquid container that stores the black ink may be, among the plurality of liquid containers, positioned at an end portion on the second direction side.

According to the present aspect, since one of the liquid container among the plurality of liquid containers is a liquid container that stores black ink, and the liquid container that stores the black ink is, among the plurality of liquid containers, positioned at the end portion on the second direction side, the size of the liquid container that stores black ink can be increased by using a dead space of the apparatus, and the volume of the black ink that is consumed the most can be increased and the user needs can be answered.

In a ninth aspect according to the eighth aspect, the liquid container that stores the black ink may extend rearwardly in the depth direction with respect to the other liquid containers.

According to the present aspect, since the liquid container that stores the black ink extends rearwardly in the depth direction with respect to the other liquid containers, while achieving increase in the volume of the black ink, another component of the apparatus can be disposed in a space formed by the difference in sizes between the liquid container that stores the black ink and the other liquid containers.

A tenth aspect according to the eighth or ninth aspect may include an upper structure above the housing. In the tenth aspect, the filling port included in the liquid container that stores the black ink and the filling ports included in the other liquid containers may be disposed so as to be aligned in a linear manner in the width direction, and a distance in a horizontal direction between the filling port of the liquid container that stores the black ink and the upper structure may be larger than distances in the horizontal direction between the filling ports included in the other liquid containers and the upper structure.

In a case in which the liquid is filled into the liquid container through the filling port, when the bottle in which the liquid is stored is coupled with the filling port, the upper structure tends to be in the way. Especially, the size of the bottle in which the black ink is stored is large and the upper structure tends to be in the way.

Accordingly, in the present aspect, the distance in the horizontal direction between the filling port of the liquid container that stores the black ink and the upper structure is larger than the distances in the horizontal direction between the filling ports included in the other liquid containers and the upper structure. With the above, even when the large sized bottle having the black ink therein is coupled with the filling port, the upper structure tends not to be in the way.

In the eleventh aspect according to the tenth aspect, the distance in the horizontal direction between the filling port of the liquid container that stores the black ink and the upper structure may be set larger than the distances in the horizontal direction between the filling ports included in the other liquid containers and the upper structure by having a corner portion of a front surface of the upper structure on the second direction side have a beveled shape or a round shape.

According to the present aspect, since the distance in the horizontal direction between the filling port of the liquid container that stores the black ink and the upper structure is set larger than the distances in the horizontal direction between the filling ports included in the other liquid containers and the upper structure by having the corner portion of the front surface of the upper structure on the second direction side have a beveled shape or a round shape, the distance in the horizontal direction between the filling port included in the liquid container that stores the black ink and the upper structure can be created easily.

In a twelfth aspect according to the tenth or eleventh aspect, a lateral surface of the upper structure on the second direction side, a lateral surface of the housing on the second direction side, and a lateral surface of the liquid storage portion on the second direction side may be flush with each other.

According to the present aspect, since the lateral surface of the upper structure on the second direction side, the lateral surface of the housing on the second direction side, and the lateral surface of the liquid storage portion on the second direction side are flush with each other, the liquid storage portion does not protrude in the second direction and the dimension of the apparatus in the width direction can be suppressed.

A thirteenth aspect according to any one of the first to twelfth aspects may include a medium transport path through which the medium is transported in a direction opposite a direction in which the medium is transported when recording is performed by the recording unit, and a medium inverting portion that inverts the medium, the medium having been transported through the medium transport path, towards the recording unit. In the thirteenth aspect, the liquid storage portion may extend in the depth direction to an occupying area of the medium transport path.

A recording apparatus according to a fourteenth aspect includes a recording unit that performs recording by discharging a liquid on a medium transported in a transport direction, a liquid storage portion that is disposed on an apparatus front side in an apparatus depth direction and in an area in either one of end portions in a width direction that intersects the depth direction, and that includes a plurality of liquid containers that are aligned in the width direction and that store ink discharged in the recording unit, a housing that constitutes an outer shell of an apparatus body included in the recording unit, and an upper structure disposed above the housing. In the fourteenth aspect, each of the plurality of liquid containers includes a corresponding one of a plurality of filling ports through which a liquid is filled, the plurality of filling ports being disposed so as to be aligned in a linear manner in the width direction, and a distance in a horizontal direction between the filling port of the liquid container, among the plurality of liquid containers, disposed on an outermost side, the side being a side on which the either one of the end portions is located, and the upper structure is larger than distances in the horizontal direction between the filling ports of the other liquid containers and the upper structure.

In the fifteenth aspect according to the fourteenth aspect, the distance in the horizontal direction between the filling port of the liquid container, among the plurality of liquid containers, disposed on the outermost side, the side being a side on which the either one of the end portions is located, and the upper structure may be set larger than the distances in the horizontal direction between the filling ports of the other liquid containers and the upper structure by having a corner portion of a front surface of the upper structure on the side on which the either one of the end portions is located have a beveled shape or a round shape.

In the sixteenth aspect according to the fourteenth or fifteenth aspect, the liquid container, among the plurality of liquid containers, disposed on the outermost side, the side being a side on which the either one of the end portions is located, may be a liquid container storing black ink.

In a seventeenth aspect according to any one of the fourteenth to sixteenth aspects, the liquid storage portion may include a protruding portion that protrudes forwardly from a front surface of the either one of the end portions of the housing, and the liquid storage portion may be configured to, at an upper portion of the protruding portion, expose the plurality of filling ports.

Hereinafter, the present disclosure will be described in detail.

Note that in each drawing, a direction extending along the X axis is an apparatus width direction, which is a direction intersecting a sheet transport direction or, in other words, is a sheet width direction. The −X direction is the right direction from the view of the user facing an apparatus front surface and is a first direction. Furthermore, the +X direction is the left direction from the view of the user facing the apparatus front surface and is a second direction.

Furthermore, a direction extending along the Y axis is an apparatus depth direction, the +Y direction is a direction extending from an apparatus rear surface towards the front surface, and the −Y direction is a direction extending from the apparatus front surface towards a rear surface.

Furthermore, a direction extending along the Z axis is the vertical direction, the +Z direction is a direction extending towards the upper side in the vertical direction, and the −Z direction is a direction extending towards the lower side in the vertical direction.

Among the lateral surfaces constituting a periphery of the apparatus according to the present exemplary embodiment, a lateral surface in which an operation unit 5 is provided is the apparatus front surface.

Figure 2:
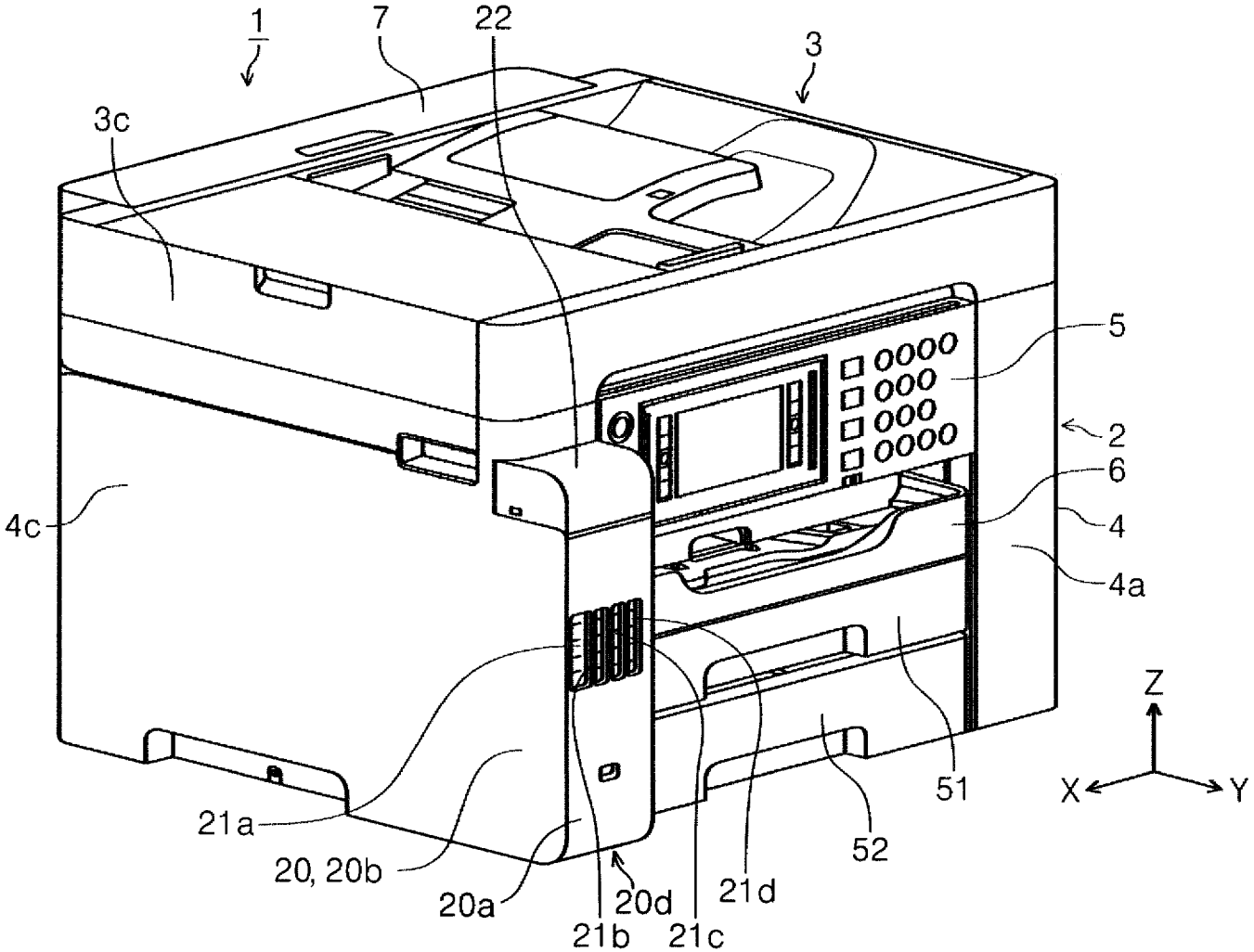
FIG. 2 is a perspective view of the printer according to the first exemplary embodiment.

Referring to FIGS. 1 and 2, an ink jet printer 1 that is an example of the recording apparatus includes a scanner unit 3, serving as an upper structure, above the apparatus body 2. Hereinafter, the ink jet printer is abbreviated to a "printer".

An outer shell of the apparatus body 2, as a whole, is box shaped. The outer shell is formed so that a right lateral surface and a left lateral surface of the apparatus body 2 are substantially flush with a right lateral surface and a left lateral surface of the scanner unit 3. Note that the right lateral surfaces and the left lateral surfaces of the apparatus body 2 and the scanner unit 3 are each formed of a perpendicular smooth surface.

In FIG. 1, reference numeral 3*b* is the right lateral surface of the scanner unit 3, and reference numeral 4*b* is a right lateral surface of a housing 4 constituting the outer shell of the apparatus body 2. Furthermore, in FIG. 2, reference numeral 3*c* is the left lateral surface of the scanner unit 3, and reference numeral 4*c* is the left lateral surface of the housing 4. Furthermore, reference numeral 20*b* is a left lateral surface of an ink storage unit 20 described later.

The apparatus body 2 has a function of performing recording on a recording sheet, which is an example of the medium. The scanner unit 3 has a function of reading a document. Note that the scanner unit 3 includes an automatic document feeding mechanism (ADF or auto document feeder) that automatically feeds the set document. The apparatus body 2 includes transport paths (described later) that transport a recording sheet, and a recording head 9 (FIG. 3) that is an example of a recording unit. In the present exemplary embodiment, the apparatus body 2 further includes two medium storage cassettes, specifically, a first sheet cassette 51 and a second sheet cassette 52 that are configured to be detached from the apparatus body 2.

Furthermore, the apparatus body 2 is configured so that sheets can be set in the first sheet cassette 51 and the second sheet cassette 52 and, additionally, is configured so that sheets can also be set and fed through the apparatus rear surface. Reference numeral 7 is a cover that opens and closes a sheet setting port (not shown) when setting the sheet through the apparatus rear surface.

The apparatus body 2 includes, on the apparatus front surface, the operation unit 5 through which various operations of the printer 1 is performed. The operation unit 5 includes a display portion and a plurality of operation buttons, and is configured to tilt.

A tray 6 is provided below the operation unit 5. The tray 6 receives the recording sheet that is discharged after recording has been performed thereon. As illustrated in FIGS. 1 and 2, the tray 6 is provided so as to be capable of being in a state in which the tray 6 is housed inside the apparatus body 2 and a state in which the tray 6 is drawn out (not shown) from the apparatus body 2.

The outer shell of the apparatus body 2 includes the housing 4. In the front surface of the housing 4, a front surface 4*a* in an end portion on the first direction side is a perpendicular smooth surface. The front surfaces of the scanner unit 3, the tray 6, the first sheet cassette 51, and the second sheet cassette 52 are also formed of perpendicular smooth surfaces. When the operation unit 5 is in a closed state, an operation surface thereof becomes a perpendicular surface. As illustrated in FIGS. 1 and 2, in the apparatus front surface, the front surfaces of the scanner unit 3, the tray 6, the first sheet cassette 51, and the second sheet cassette 52 are substantially flush with the operation surface of the operation unit 5.

The ink storage unit 20 is provided on the left side of the front surface of the apparatus body 2.

Figure 6:
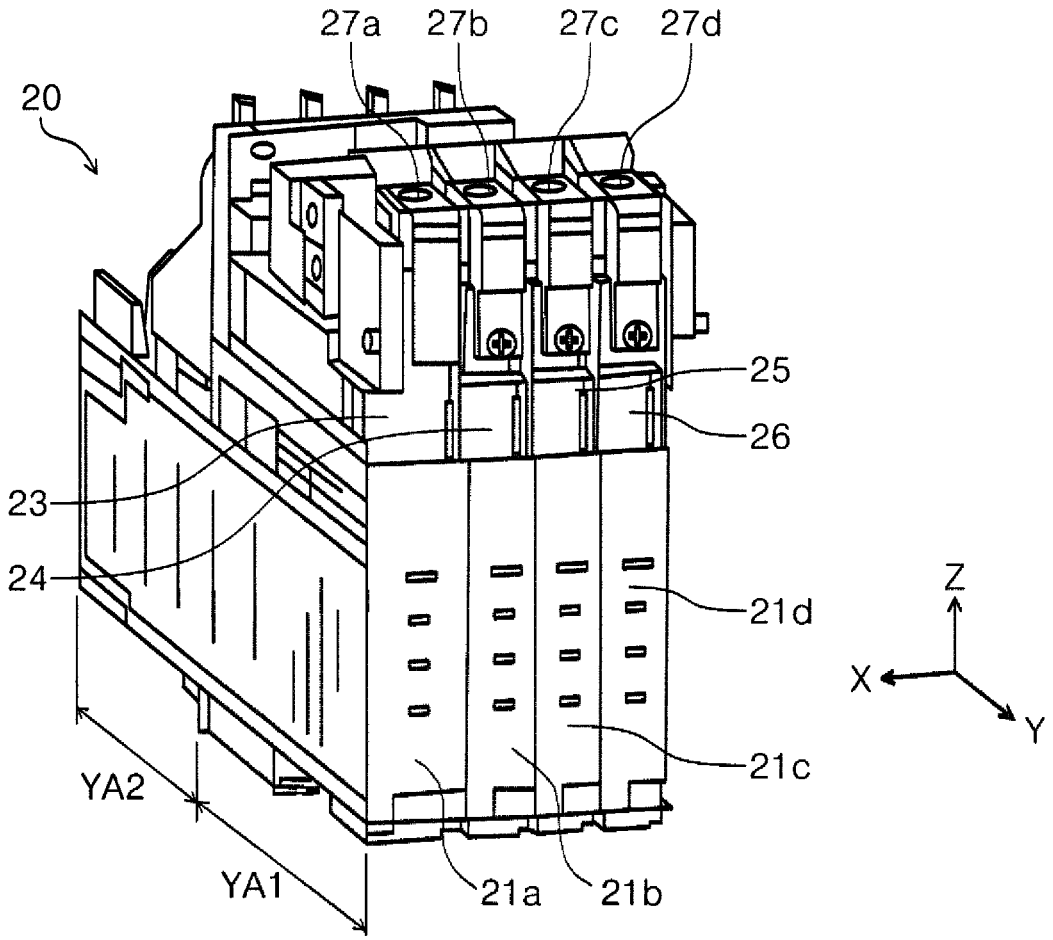
FIG. 6 is a perspective view of a plurality of ink tanks viewed from the front.
Figure 7:
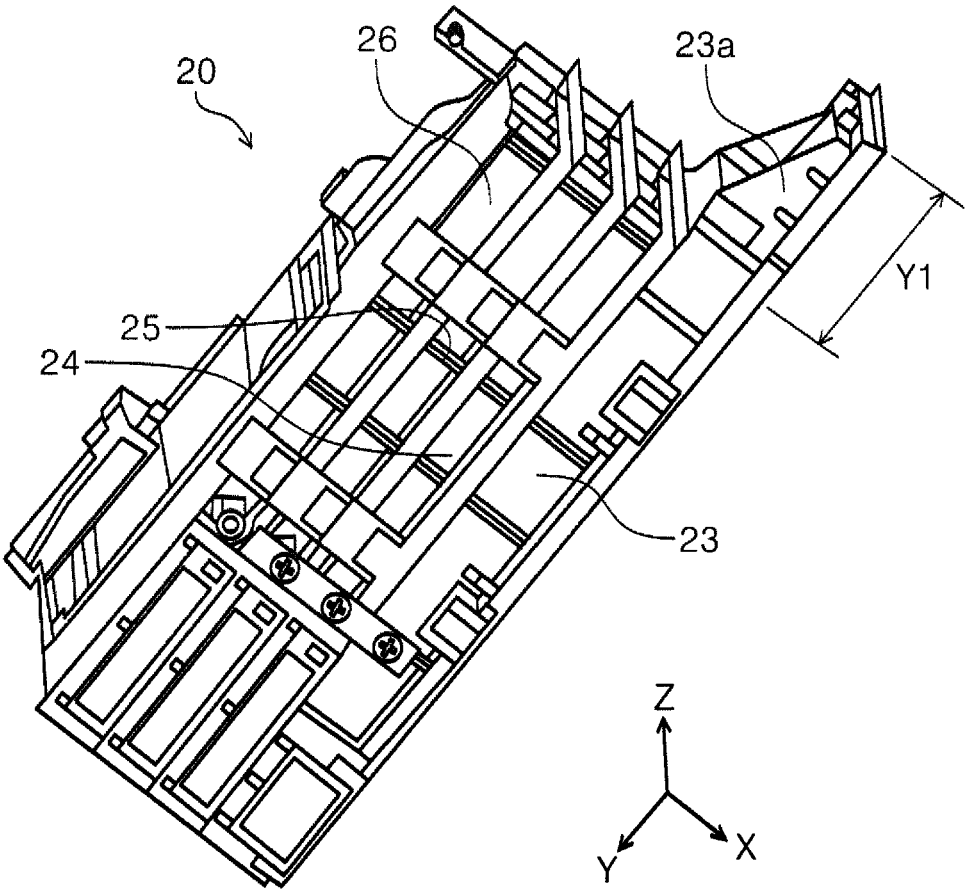
FIG. 7 is a perspective view of the plurality of ink tanks viewed from below.

Ink tanks serving as ink storage containers that store ink are provided inside the ink storage unit 20. Specifically, as illustrated in FIGS. 6 and 7, four ink tanks are provided in the present exemplary embodiment. The four ink tanks denoted by reference numerals 23, 24, 25, and 26 constitute the ink storage unit 20.

Among the above, reference numeral 23 is the ink tank that stores black ink, and reference numerals 24, 25, and 26 are the ink tanks that store colored ink. Hereinafter, the ink tank that stores black ink is referred to as a BK ink tank, and the ink tanks that store colored ink are referred to as CL ink tanks. The colored ink includes yellow ink, magenta ink, and cyan ink, for example.

An outer shell of the ink storage unit 20 is integrally formed with the housing 4. In the housing 4, openings are formed in the front surface of the ink storage unit 20. Residual quantity checking portions 21*a*, 21*b*, 21*c*, and 21*d*, each for visually checking the residual quantity of the ink, are formed inside the openings.

A cover 22 configured to open and close is provided at an upper portion of the ink storage unit 20 so that by opening the cover 22, ink refilling work can be performed. The ink refilling work will be described in detail later.

Figure 3:
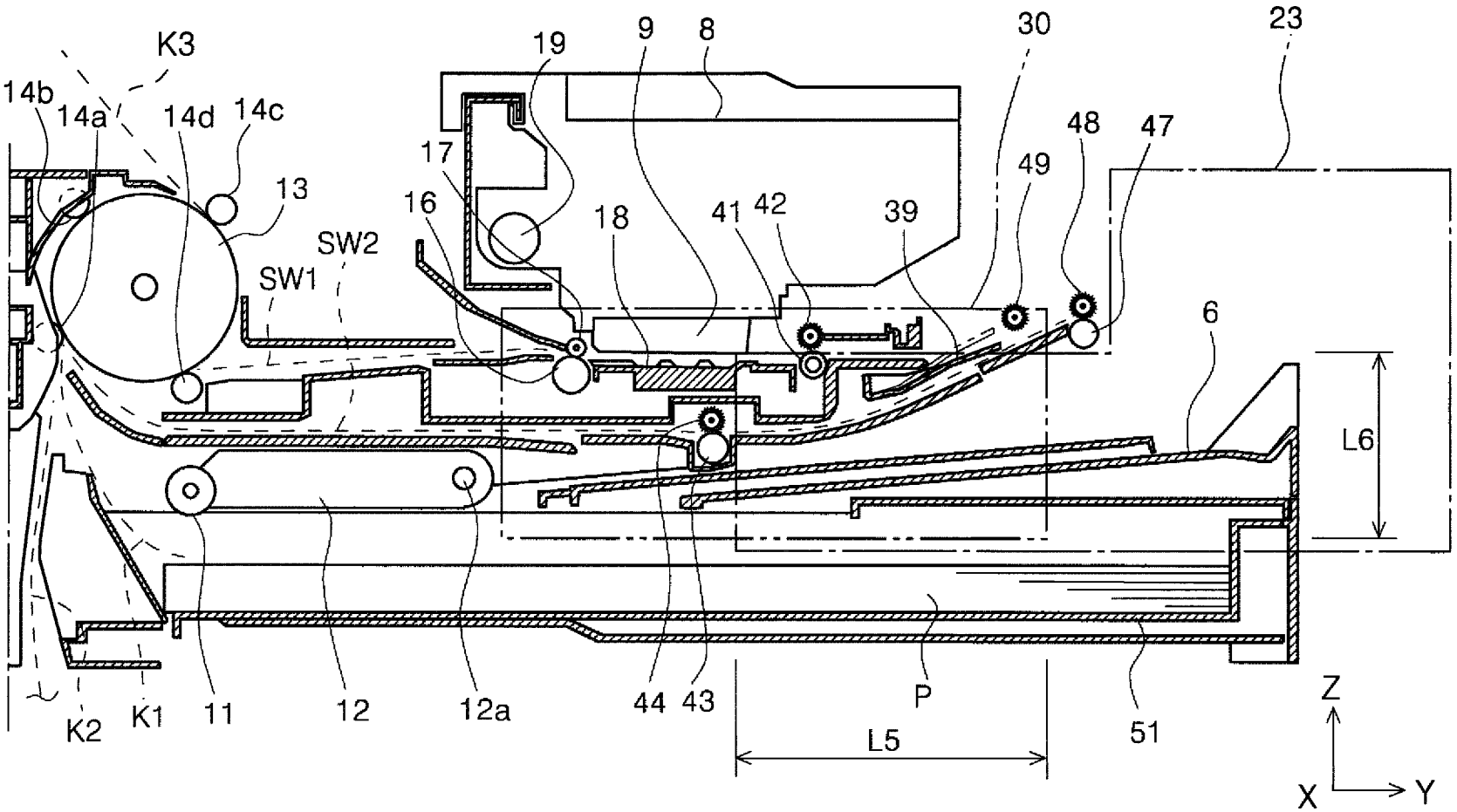
FIG. 3 is a sectional side view illustrating sheet transport paths of the printer according to the first exemplary embodiment.

Referring next to FIG. 3, transport paths of the recording sheet will be described. Note that in FIG. 3, the second sheet cassette 52 is not illustrated.

In the printer 1, regardless of the feeding path, the recording sheet is transported to a transport drive roller 16 through an inverting roller 13 serving as a sheet inverting portion, and is transported to a recording area, which is an area where recording is performed by the recording head 9, with the transport drive roller 16.

As sheet feeding paths, the printer 1 includes a sheet feeding path K1 that feeds the recording sheet from the first sheet cassette 51, a sheet feeding path K2 that feeds the recording sheet from the second sheet cassette 52 located below the first sheet cassette 51, and a sheet feeding path K3 in which the recording sheet is fed manually from a rear upper portion of the apparatus.

As paths that invert the recording sheet on which recording has been performed, the printer 1 further includes a first inversion path SW1 that sends the recording sheet from the transport drive roller 16 to the inverting roller 13, and a second inversion path SW2 that is located under the first inversion path SW1 and that sends the recording sheet from a second discharge drive roller 47 to the inverting roller 13 through an inversion drive roller 43.

In the sheet feeding path K1, the recording sheet is fed with a feed roller 11. The feed rollers 11 is supported by a support member 12 that swings about a rocking shaft 12*a*. By swinging the support member 12, the feed rollers 11 is advanced/retracted to/from a recording sheet P that is stored in the first sheet cassette 51.

A similar feed mechanism (not shown) is also provided in the second sheet cassette 52 (not shown in FIG. 3) provided below the first sheet cassette 51.

The inverting roller 13 is formed to have a large diameter, and warps and inverts the recording sheet. Driven rollers 14*a*, 14*b*, 14*c*, and 14*d* are provided around the inverting roller 13. The recording sheets fed through the sheet feeding paths K1 and K2 pass through the driven rollers 14*a*, 14*b*, and 14*c*. The recording sheet fed through the sheet feeding path K3 passes through the driven roller 14*c*. The recording sheet fed through the first inversion path SW1 passes through the driven rollers 14*d*, 14*a*, 14*b*, and 14*c*. The recording sheet fed through the second inversion path SW2 passes through the driven rollers 14*a*, 14*b*, and 14*c*.

The transport drive roller 16 that is driven by a power source and a transport driven roller 17 that is driven and rotated by the transport drive roller 16 are provided downstream of the inverting roller 13. The recording sheet is sent to an area facing the recording head 9, in other words, the recording sheet is sent to the recording area with the above pair of rollers.

A carriage 8 provided with the recording head 9 is reciprocated in the X direction with a power source while being guided by a carriage guide shaft 19 extending in the X direction.

Figure 4:
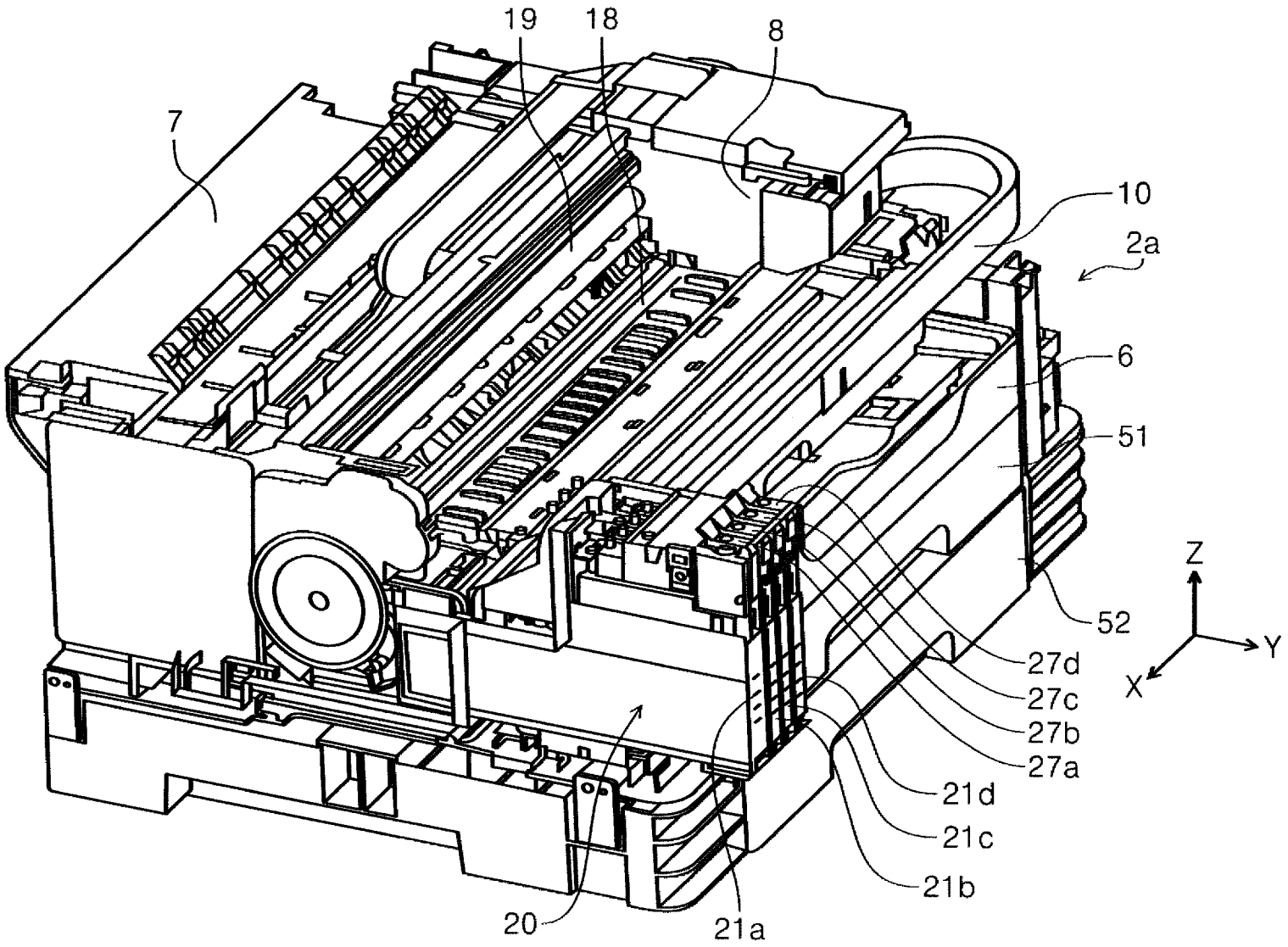
FIG. 4 is a perspective view of a structure of the printer according to the first exemplary embodiment.

The carriage guide shaft 19 is also illustrated in FIG. 4. FIG. 4 illustrates the printer 1 from which the housing 4 constituting the outer shell of the apparatus has been removed, and reference numeral 2*a* denotes a structure of the printer 1, which constitutes the inside of the housing 4.

In the present exemplary embodiment, the first direction is the right direction, or the −X direction, when the apparatus front surface is in front of the viewer. A home position of the carriage 8 is set in an end portion area on the first direction side. The second direction is the left direction, or the +X direction, when the apparatus front surface is in front of the viewer. The ink storage unit 20 is provided in an end portion area on the second direction side.

The carriage 8 and the ink storage unit 20 are coupled to each other through a flexible ink tube 10. The ink stored in the ink storage unit 20 is supplied to the recording head 9 in the carriage 8 through the ink tube 10.

Figure 8:
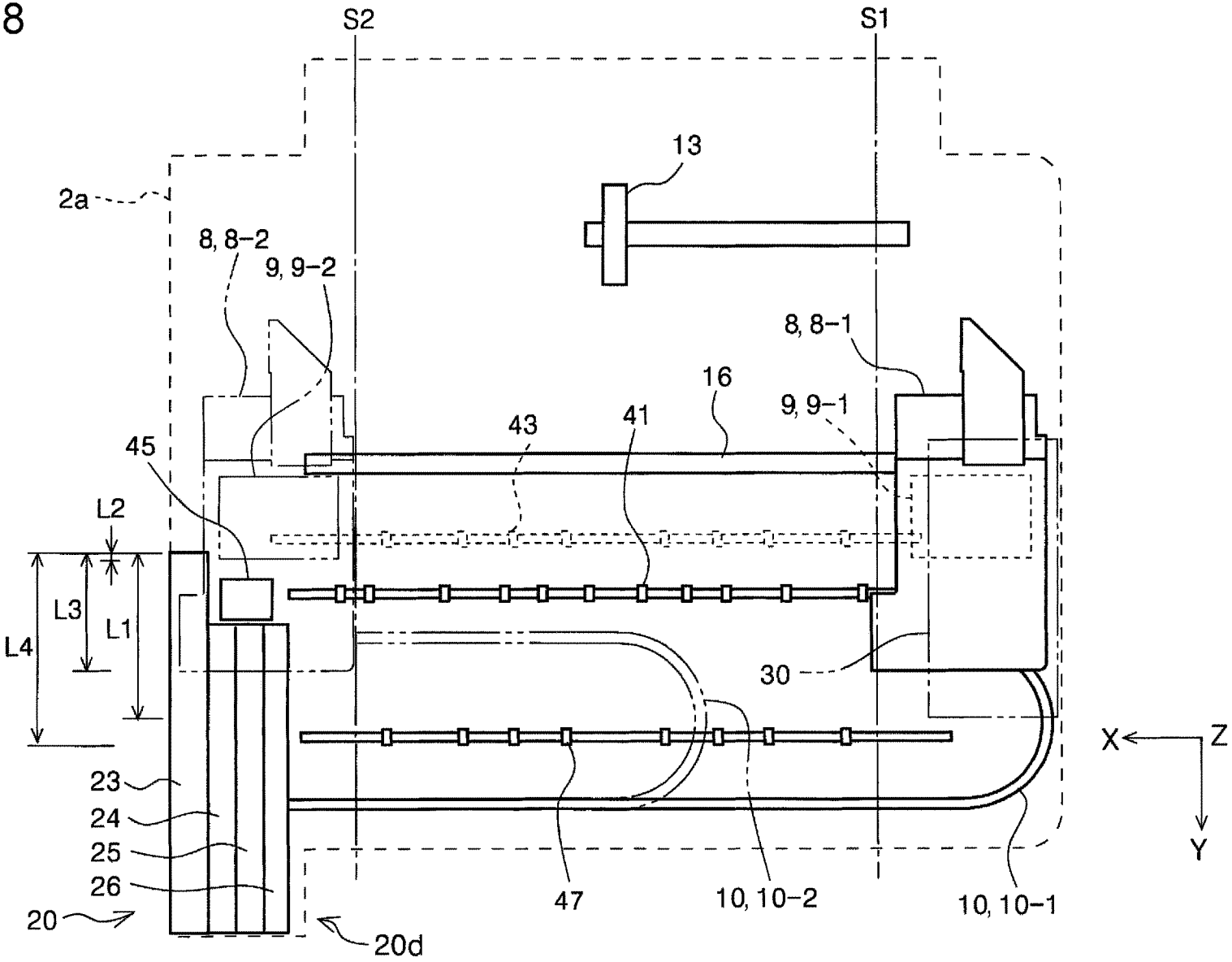
FIG. 8 is a plan view illustrating positional relationships of components of the printer according to the first exemplary embodiment.

In FIG. 8, the two-dot chain line and reference numeral 10-2 illustrate a state of the ink tube 10 when the carriage 8 is positioned at the end portion on the second direction side.

Figure 5:
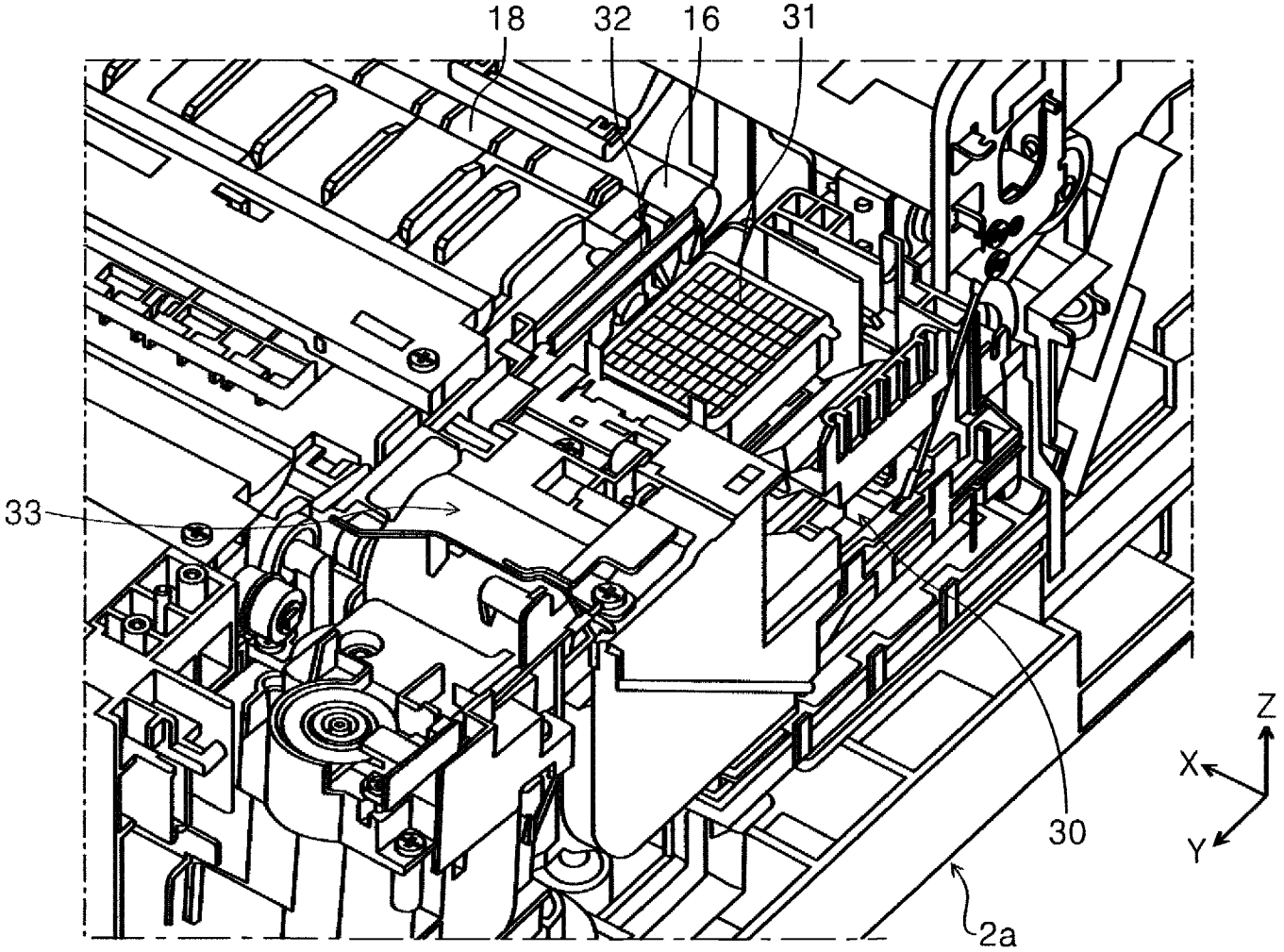
FIG. 5 is a perspective view of a maintenance mechanism.

As illustrated in FIG. 5, a maintenance unit 30 that performs maintenance on the recording head 9 is provided in the end portion area on the first direction side. The maintenance unit 30 includes a cap portion 31 that covers the recording head 9 when the carriage 8 is at the home position, a blade 32 that, associated with the moving operation of the carriage 8, wipes a head surface of the recording head 9, and a pump 33 that suctions ink from the ink discharge nozzles of the recording head 9 by creating a negative pressure in the cap portion 31.

Referring back to FIG. 3, a support member 18 is provided at a position opposing the recording head 9. The recording sheet on which recording is performed with the recording head 9 is supported by the support member 18.

A rotationally driven first discharge drive roller 41 and a discharge driven roller 42 that is driven and rotated are provided downstream of the support member 18. The first discharge drive roller 41 and the discharge driven roller 42 send the recording sheet on which recording has been performed downstream. The first discharge drive roller 41 and the discharge driven roller 42, which is driven and rotated, are the first pair of rollers positioned downstream of the recording head 9.

Furthermore, the rotationally driven second discharge drive roller 47 and a discharge driven roller 48 that are driven and rotated are provided downstream of the above pair of rollers.

In the printer 1 including the sheet feeding paths described above, the feed roller 11 and the inverting roller 13 are driven by a first motor (not shown), the transport drive roller 16 and the first discharge drive roller 41 are driven by a second motor (not shown), and the second discharge drive roller 47 and the inversion drive roller 43 are driven by a motor 45 (FIG. 8) serving as a third motor.

Hereinafter, the first inversion path SW1 and the second inversion path SW2 will be described further.

When recording is performed on a second surface of a recording sheet on which recording has been performed on a first surface, the second surface being a surface opposite the first surface, the recording sheet on which recording has been performed is transported in a direction (−Y direction) opposite the transport direction (+Y direction) during the recording and is sent to the inverting roller 13. In so doing, either the first inversion path SW1 or the second inversion path SW2 can be selected as the sheet transport path.

In the present exemplary embodiment, the first inversion path SW1 is defined as a path from the second discharge drive roller 47 to the driven roller 14*d*. In the present exemplary embodiment, the second inversion path SW2 is defined as a path from the second discharge drive roller 47 to the driven roller 14*a* passing through the inversion drive roller 43. A path length of the second inversion path SW2 is longer than the path length of the first inversion path SW1. Accordingly, a control unit (not shown) of the printer 1 having a threshold value selects the second inversion path SW2 when the length of the recording sheet exceeds the threshold value and selects the first inversion path SW1 when the length of the recording sheet is equivalent to or lower than the threshold value.

When the first inversion path SW1 is used, the rotations of the transport drive roller 16, the first discharge drive roller 41, and the second discharge drive roller 47 are reversed after the completion of the recording on the first surface. With the above, the recording sheet is transported in the −Y direction and reaches the inverting roller 13 through the first inversion path SW1.

When the second inversion path SW2 is used, the recording sheet is, after the recording on the first surface has been completed, transported in the +Y direction until a trailing edge of the sheet reaches a driven roller 49 provided upstream and near the second discharge drive roller 47 and, subsequently, the rotation of the second discharge drive roller 47 is reversed. A flap 39 that is configured to swing is provided upstream of the driven roller 49. When the recording sheet is sent through the second inversion path SW2, a +Y direction end portion of the flap 39 is lifted. With the above, the recording sheet is transported in the −Y direction, is sent into the second inversion path SW2, and is sent to the inverting roller 13.

The second discharge drive roller 47 and the inversion drive roller 43 receive motive power from the motor 45 (FIG. 8), which is a common drive source. Note that a rotation restricting mechanism (not shown) is provided in a motive power transmitting path from the motor 45 to the inversion drive roller 43, and due to the rotation restricting mechanism, the inversion drive roller 43 rotates in a direction transporting the recording sheet in the −Y direction (the counterclockwise direction in FIG. 3) regardless of the rotation direction of the motor 45. The rotation restricting mechanism can be a mechanism including a one way clutch or a mechanism including a planetary gear mechanism, for example.

On the other hand, the second discharge drive roller 47 rotates in the normal direction when the motor 45 rotates in the normal direction, and rotates in the reverse direction when the motor 45 rotates in the reverse direction.

Referring mainly to FIG. 8, positional relationships of the components will be described next.

In the printer 1 according to the present exemplary embodiment, the maintenance unit 30 is, in the apparatus width direction that is a direction intersecting an apparatus depth direction, provided in the end portion area on the first direction side, and the ink storage unit 20 is provided in the end portion area on the second direction side and extends in a depth direction or in the Y direction to the occupying area of the maintenance unit 30.

More specifically, reference numeral L1 in FIG. 8 illustrates a range in which the BK ink tank 23 and the maintenance unit 30 overlap each other in the Y direction. Note that as it is apparent from FIG. 8, the CL ink tanks 24, 25, and 26 also overlap the maintenance unit 30 in the Y direction. Note that in FIG. 8, the occupying area of the maintenance unit 30 is indicated by a two-dot chain line.

In other words, since the ink storage unit 20 disposed on the apparatus front side is provided, in the apparatus width direction, in the end portion area on the second direction side that is opposite the end portion area on the first direction side where the maintenance unit 30 that performs maintenance on the recording head 9 is provided, interference between the ink storage unit 20 and the maintenance unit 30 can be avoided and the occupying area of the ink storage unit 20 can be extended in the apparatus depth direction (−Y direction). Furthermore, since the ink storage unit 20 extends to the occupying area of the maintenance unit 30 in the apparatus depth direction, the protrusion amount of the ink storage unit 20 from the apparatus front surface can be suppressed while increasing the ink storage amount.

Note that the maintenance unit 30 being provided in the end portion area on the first direction side means that the maintenance unit 30 is positioned on the first direction side with respect to the carriage 8 when the carriage 8 is positioned in the end portion on the first direction side, or that a portion of the maintenance unit 30 overlaps the carriage 8 in the apparatus width direction.

Similarly, the ink storage unit 20 being provided in the end portion area on the second direction side means that the ink storage unit 20 is positioned on the second direction side with respect to the carriage 8 when the carriage 8 is positioned in the end portion on the second direction side, or that a portion of the ink storage unit 20 overlaps the carriage 8 in the apparatus width direction.

Note that in FIG. 8, reference numeral S1 indicates the position of the first direction end portion of the sheet transport area, and reference numeral S2 indicates the second direction end portion of the sheet transport area. As illustrated in the drawing, in the present exemplary embodiment, the ink storage unit 20 and the maintenance unit 30 are both provided outside the sheet transport area. Accordingly, the maintenance unit 30 being provided in the end portion area on the first direction side may be defined as the maintenance unit 30 being provided outside the sheet transport area in the first direction, and the ink storage unit 20 being provided in the end portion area on the second direction side may be defined as the ink storage unit 20 being provided outside the sheet transport area in the second direction.

Note that BK ink tank 23 storing black ink is one of the plurality of ink tanks, and the BK ink tank 23 is, among the plurality of ink tanks, positioned at the end portion on the second direction side. With the above, the size of the BK ink tank 23 can be increased using a dead space inside the apparatus. Accordingly, the volume of the black ink that is consumed the most can be increased and the user needs can be answered.

Furthermore, a width of the BK ink tank 23 in the width direction (the X direction) is larger than those of the CL ink tanks 24, 25, and 26. The BK ink tank 23 extends rearwardly or towards the −Y direction side in the depth direction. In FIG. 7, reference numeral Y1 illustrates a range where the BK ink tank 23 extend more in the −Y direction compared to the other tanks, namely, the CL ink tanks 24, 25, and 26.

With such a configuration, while achieving an increase in the volume of the BK ink tank 23, a component of the apparatus can be disposed in the space formed by the difference in sizes between the BK ink tank 23 and the other tanks, namely, the CL ink tanks 24, 25, and 26. In the present exemplary embodiment, as illustrated in FIG. 8, the motor 45 is disposed in the space formed by the difference in the sizes between the BK ink tank 23 and the other tanks, namely, the CL ink tanks 24, 25, and 26.

Furthermore, the present exemplary embodiment includes the pair of rollers including the first discharge drive roller 41 and the discharge driven roller 42 that are the first pair of rollers positioned downstream of the recording area, which is where the recording head 9 performs recording, and that serves as a pair of downstream rollers that send the recording sheet, on which recording has been performed, downstream. The ink storage unit 20 extends, in the apparatus depth direction, to a position on the apparatus rear side or the −Y direction side with respect to the pair of downstream rollers. The above is clearly illustrated in FIG. 8. In the present exemplary embodiment, the volume of the BK ink tank 23 can be increased with such a configuration.

Furthermore, in the present exemplary embodiment, the BK ink tank 23 further extends in the apparatus depth direction to the position of the recording head 9. In FIG. 8, reference numeral L2 indicates a range in which the BK ink tank 23 and the recording head 9 overlap each other in the Y direction. In the present exemplary embodiment, the volume of the BK ink tank 23 can be increased with such a configuration.

Furthermore, in the present exemplary embodiment, all of the ink tanks include a first ink storage area and a second ink storage area. A height of the second ink storage area is lower than that of the first ink storage area, and the second ink storage area extends to the occupying area of the maintenance unit 30 in the apparatus depth direction.

In FIG. 6, reference numeral YA1 denotes the first ink storage area in each ink tank, and reference numeral YA2 denotes the second ink storage area in each ink tank. As it is clear from FIG. 6, a height of the second ink storage area YA2 is lower than that of the first ink storage area YA1.

With such a configuration, it will be easier to, in the apparatus depth direction, extend the length of each ink tank towards the rear side or in the −Y direction and effectively increase the volume of each ink tank.

Furthermore, with such a configuration, a portion of the second ink storage area YA2 is positioned below the reciprocating area of the carriage 8. With the above, the dimension of the apparatus in the apparatus width direction can be suppressed. In FIG. 8, reference numeral L3 denotes a range positioned below the reciprocating area of the carriage 8 in the second ink storage area YA2. In other words, it can be said that the reciprocating area of the carriage 8 and the second ink storage area YA2 overlap each other in both the apparatus depth direction and the apparatus width direction.

Note that in FIG. 8, the carriage 8 positioned in the end portion on the second direction side is depicted by reference numeral 8-2 and a two-dot chain line, and the recording head 9 in the above instance is depicted by reference numeral 9-2 and a two-dot chain line.

Furthermore, in the present exemplary embodiment, the ink storage unit 20 extends, in the apparatus depth direction, to the occupying area of the second inversion path SW2. In other words, the second inversion path SW2 and the ink storage unit 20 overlap each other in the apparatus depth direction. In FIG. 8, reference numeral L4 indicates a range where the second inversion path SW2 and the ink storage unit 20 overlap each other in the apparatus depth direction.

With such a configuration, the dimension of the apparatus in the apparatus depth direction can be suppressed.

Note that as illustrated in FIG. 2, the lateral surface of the scanner unit 3 on the second direction side or the left lateral surface 3*c*, the lateral surface of the housing 4 on the second direction side or the left lateral surface 4*c*, and the lateral surface of the ink storage unit 20 on the second direction side or the left lateral surface 20*b* are formed so as to be flush with each other. With the above, the ink storage unit 20 does not protrude in the second direction and the dimension of the apparatus in the apparatus width direction can be suppressed.

Figure 9:
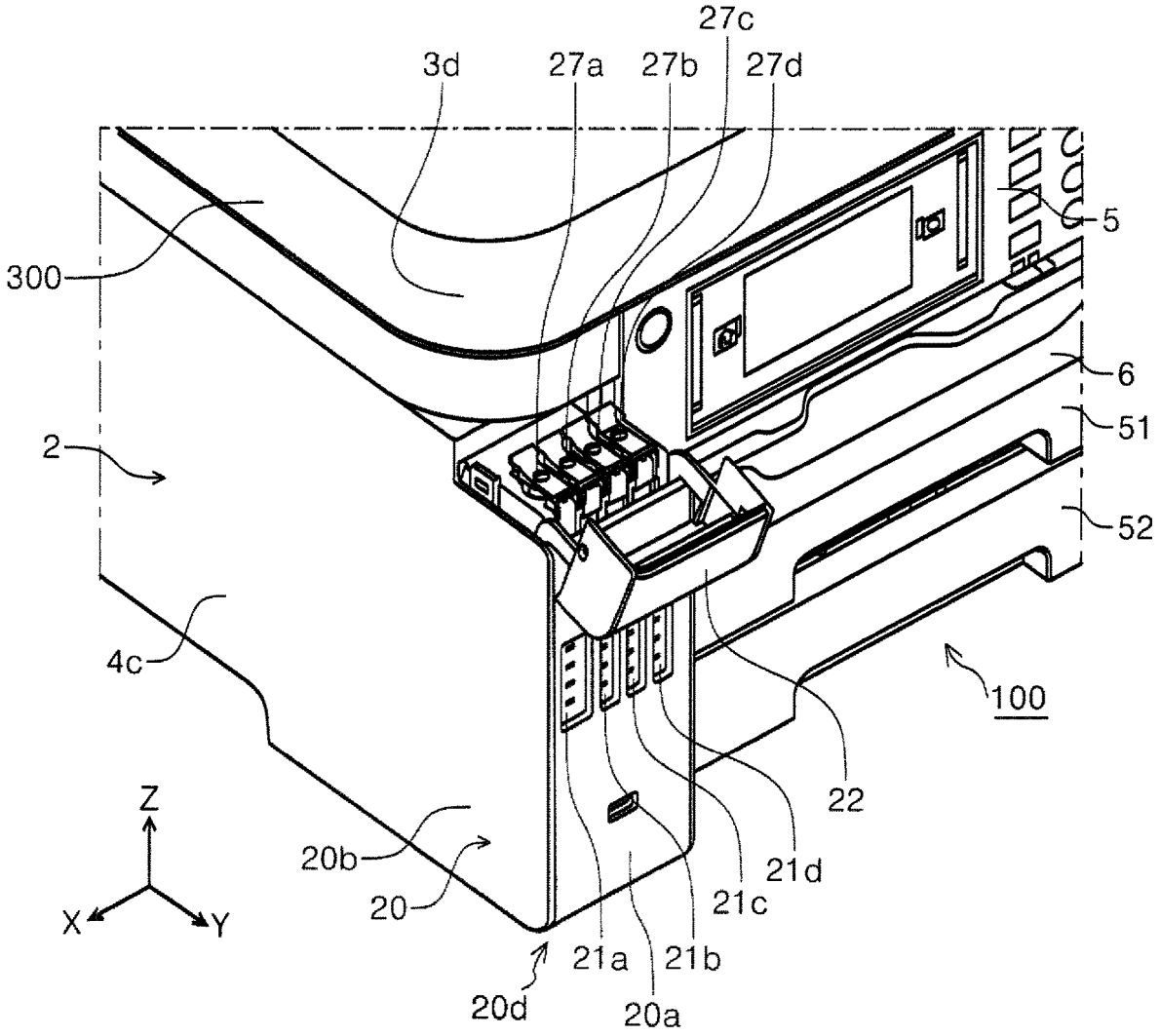
FIG. 9 is a perspective view of an essential portion of a printer according to a second exemplary embodiment.

Ink filling ports included in the ink tanks will be described next. Note that the description will be given using a printer 100 according to a second exemplary embodiment illustrated in FIG. 9 and in figures succeeding FIG. 9. There is only one point different between the printer 100 according to the second exemplary embodiment and the printer 1 according to the first exemplary embodiment described above, and that is that a corner portion of the scanner unit, serving as the upper structure, on the front surface (a corner portion on the left side) has a larger rounded shape. In FIG. 9 and the figures after that, the scanner unit included in the printer 100 according to the second exemplary embodiment will be denoted with reference numeral 300.

As illustrated in FIG. 9, the ink storage unit 20 includes a protruding portion 20*d* that protrudes in the forward direction from a front surface (the front surface in FIGS. 1 and 2 denoted by reference numeral 4*a*) in the end portion on the first direction side of the housing 4. The ink storage unit 20 includes, on the upper portion thereof, filling ports 29*a* to 29*d* (FIG. 10) through which ink is filled. The filling ports 29*a* to 29*d* can be exposed at the upper portion of the protruding portion 20*d*.

Since the filling ports 29*a* to 29*d* can be exposed at the upper portion of the protruding portion 20*d*, ink refilling work to the ink tanks through the filling ports 29*a* to 29*d* can be performed easily.

Note that the filling port 29*a* is an ink filling port of the BK ink tank 23, the filling port 29*b* is an ink filling port of the CL ink tank 24, the filling port 29*c* is an ink filling port of the CL ink tank 25, and the filling port 29*d* is an ink filling port of the CL ink tank 26. In other words, the ink storage unit 20 includes a plurality of ink tanks (23 to 26) in the apparatus width direction, and each of the plurality of ink tanks (23 to 26) includes a filling port.

Figure 10:
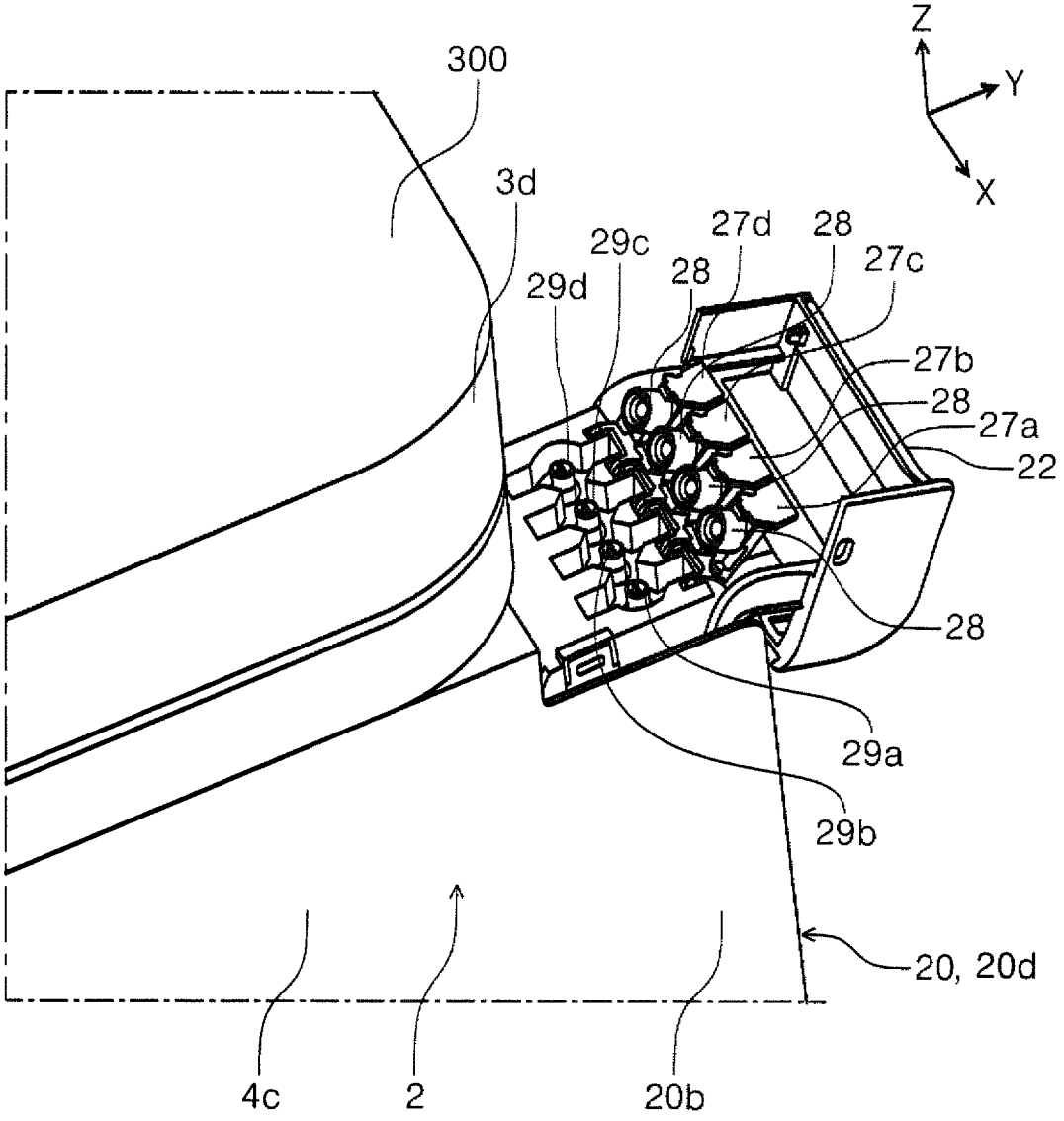
FIG. 10 is a perspective view of the essential portion of the printer according to the second exemplary embodiment.

Furthermore, the filling ports 29*a* to 29*d* each include a cap that seals the corresponding filling port and a lever that attaches the cap to the corresponding filling port. In FIG. 10, reference numerals 28 are the caps that seal the filling ports, and reference numeral 27*a* denotes the lever that attaches the cap 28 corresponding to the BK ink tank 23 to the BK ink tank 23. Furthermore, reference numeral 27*b* denotes the lever that attaches the cap 28 corresponding to the CL ink tank 24 to the CL ink tank 24, reference numeral 27*c* denotes the lever that attaches the cap 28 corresponding to the CL ink tank 25 to the CL ink tank 25, and reference numeral 27*d* denotes the lever that attaches the cap 28 corresponding to the CL ink tank 26 to the CL ink tank 26.

As illustrated by the change made between FIGS. 9 and 10, by opening each of the levers corresponding to a filling port, the filling ports become exposed.

Figure 11:
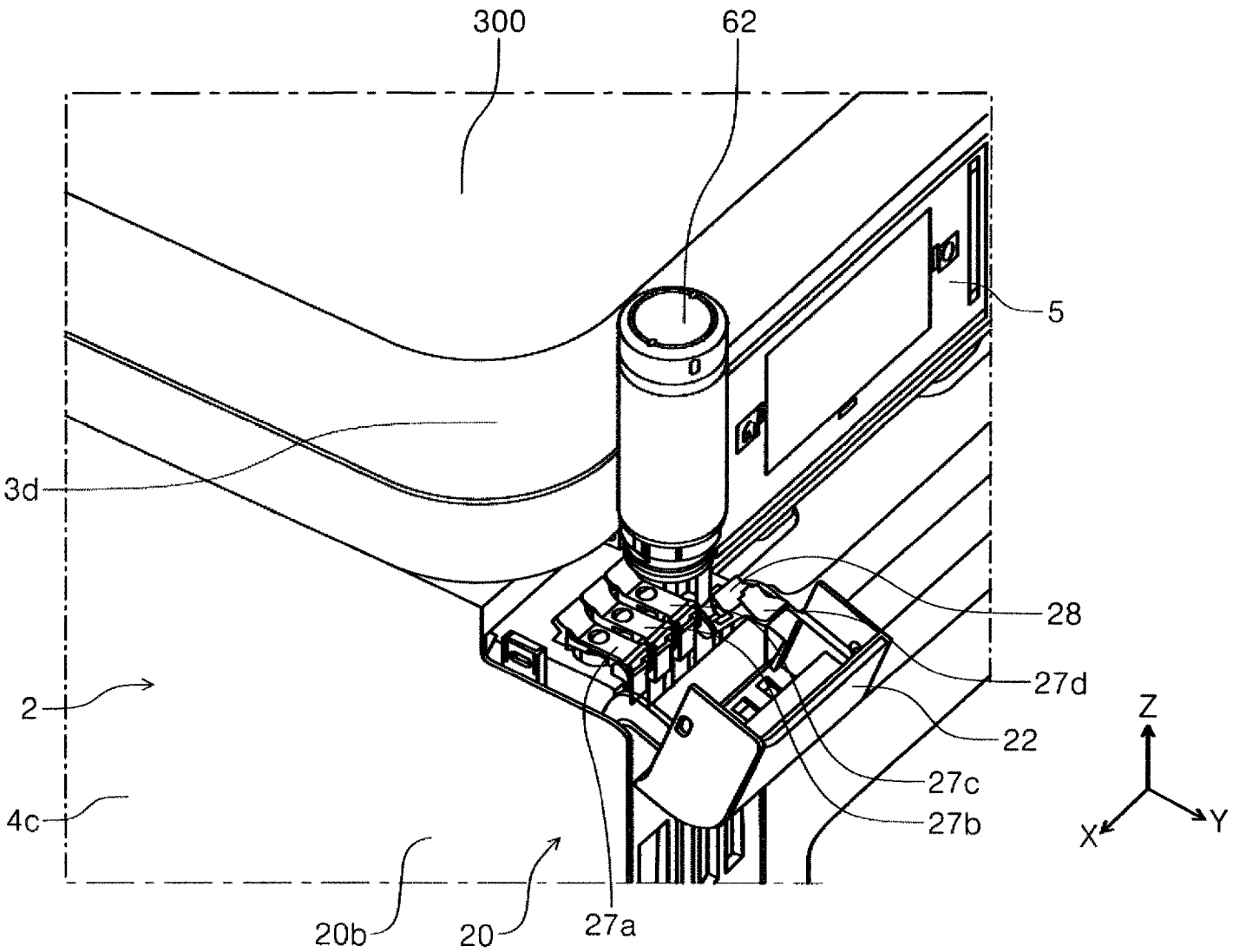
FIG. 11 is a perspective view of the essential portion of the printer according to the second exemplary embodiment.
Figure 12:
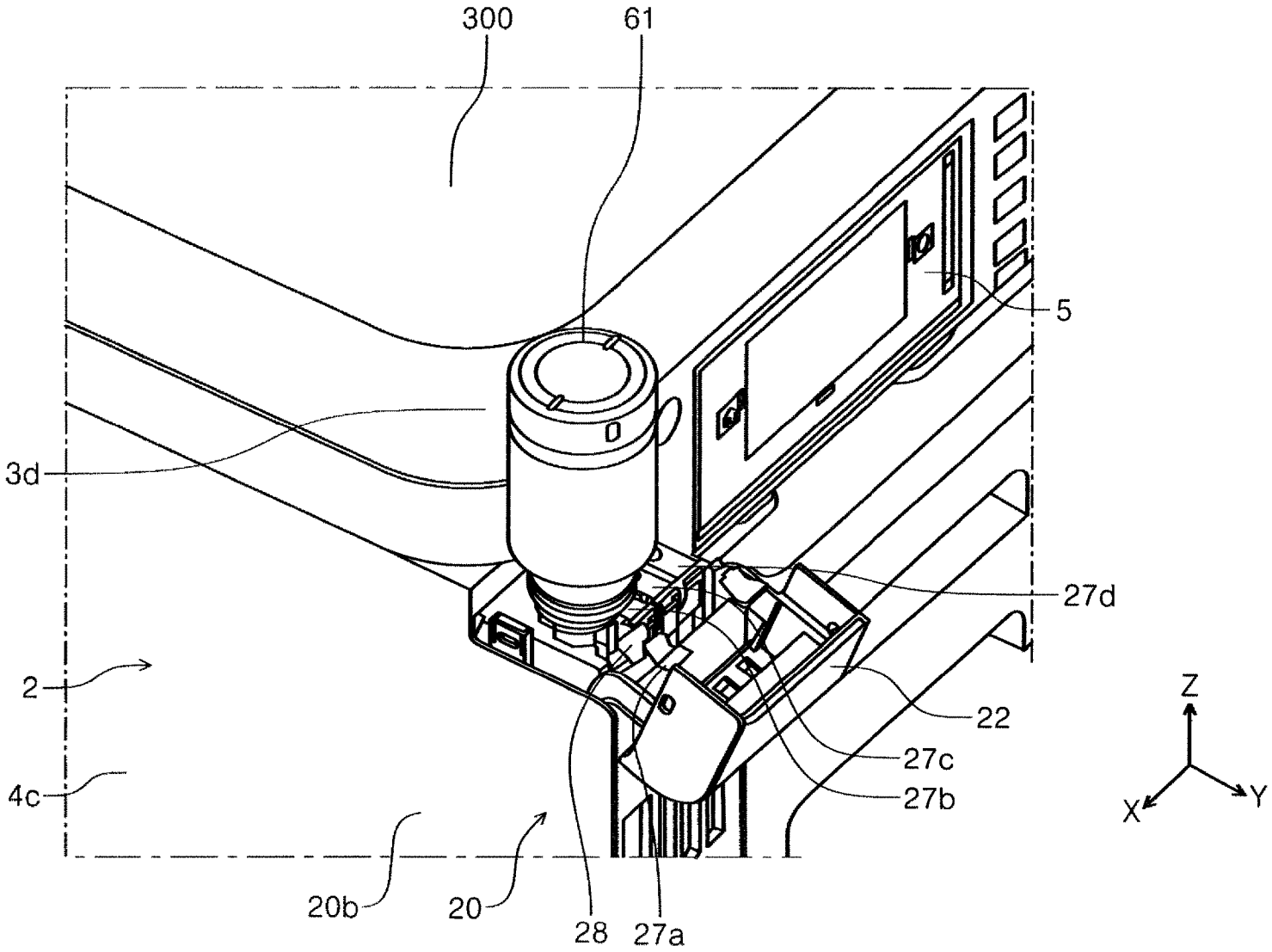
FIG. 12 is a perspective view of the essential portion of the printer according to the second exemplary embodiment.
Figure 13:
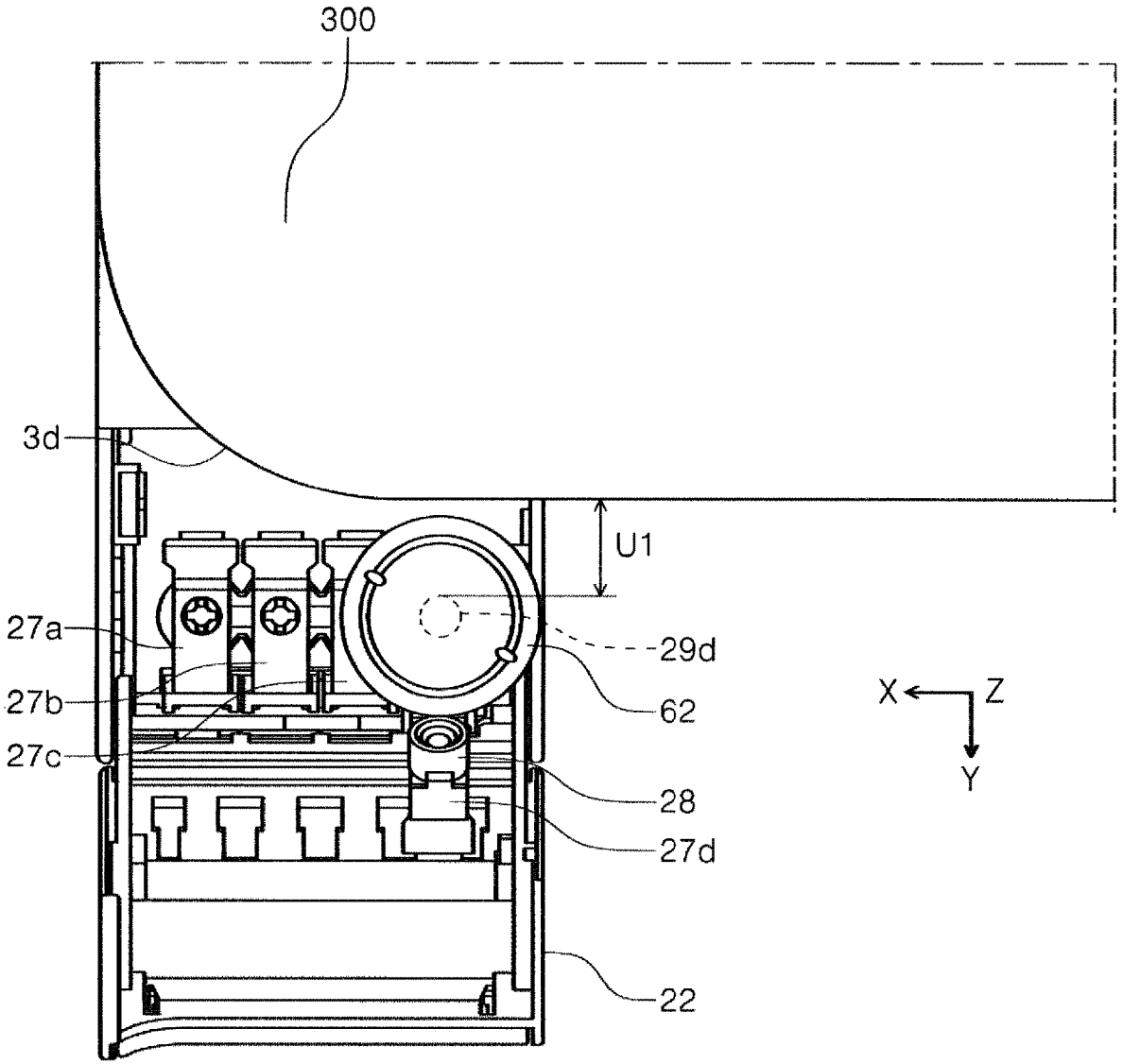
FIG. 13 is a plan view of the essential portion of the printer according to the second exemplary embodiment.

As illustrated in FIGS. 11 and 12, ink bottles that refill ink can be coupled to the filling ports. FIGS. 11 and 13 illustrates, as an example, a manner in which an ink bottle 62 is coupled to the CL ink tank 26 to fill the ink therein, and FIGS. 12 and 14 illustrates, as an example, a manner in which an ink bottle 61 is coupled to the BK ink tank 23 to fill the ink therein.

Figure 14:
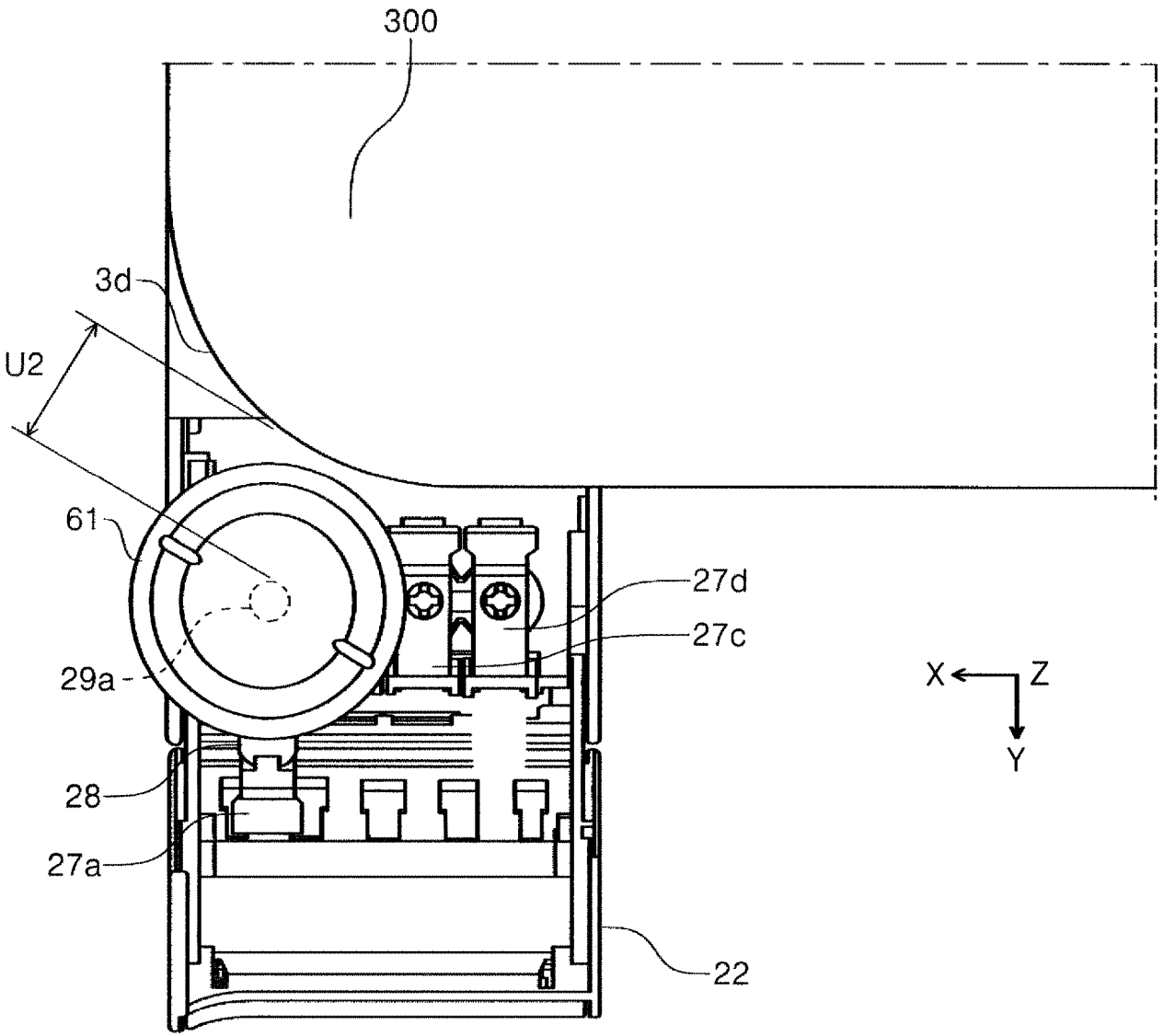
FIG. 14 is a plan view of the essential portion of the printer according to the second exemplary embodiment.

Since the amount of ink that can be stored in the BK ink tank 23 is larger than the amount of ink that can be stored in each of the CL ink tanks 24, 25, and 26, the diameter of the ink bottle 61 illustrated in FIGS. 12 and 14 is larger than the diameter of the ink bottle 62 illustrated in FIGS. 11 and 13.

The ink bottles 61 and 62 are both configured to be capable of being coupled to the corresponding filling ports in an erect state.

More specifically, as illustrated in FIG. 10, the filling port 29*a* included in the BK ink tank 23 and the filling ports 29*b* to 29*d* included in the other ink tanks, namely, the CL ink tanks 24 to 26 are disposed so as to be arranged in a linear manner in the apparatus width direction. Furthermore, a distance in the horizontal direction (U2 in FIG. 14) between the filling port 29*a* included in the BK ink tank 23 and a scanner unit 300 is larger than distances in the horizontal direction (U1 in FIG. 13) between the filling ports 29*b* to 29*d* included in the other ink tanks, namely, the CL ink tanks 24 to 26 and the scanner unit 300. The distances U1 and U2 in the horizontal direction are both shortest distances between each of the filling ports and the scanner unit 300.

Effects described below are obtained with the above configuration. In other words, when the ink bottles are coupled to the filling ports, the scanner unit 300 serving as the upper structure tends to be in the way. Especially, the size of the ink bottle 61 filled with black ink is large and the scanner unit 300 tends to be in the way.

Accordingly, as described above, the distance in the horizontal direction (U2 in FIG. 14) between the filling port 29*a* included in the BK ink tank 23 and the scanner unit 300 is made larger than the distances in the horizontal direction (U1 in FIG. 13) between the filling ports 29*b* to 29*d* included in the other ink tanks, namely, the CL ink tanks 24 to 26 and the scanner unit 300. With the above, even when the ink bottle 61 that is filled with black ink and that has a large outer diameter is coupled to the filling port 29*a*, the scanner unit 300 tends not to be in the way.

In the present exemplary embodiment, the distance U2 in the horizontal direction between the filling port 29*a* included in the BK ink tank 23 and the scanner unit 300 is created by having a corner portion 3*d* on the second direction side in the front surface of the scanner unit 300 be formed with a round shape.

However, not limited to the above, the distance U2 in the horizontal direction may be created by having the corner portion 3*d* on the second direction side in the front surface of the scanner unit 300 be formed with a beveled shape.

Alternatively, a recessed portion that receives the ink bottle 61 may be formed.

What is claimed is:

1. A recording apparatus comprising:

a recording unit that performs recording by discharging a liquid on a medium transported in a transport direction;

a liquid storage portion that is disposed on an apparatus front side in an apparatus depth direction and that includes a liquid container that contains the liquid discharged from the recording unit;

a maintenance unit that performs maintenance on the recording unit;

a carriage that is provided with a recording head that constitutes the recording unit, the carriage configured to reciprocate in the width direction, wherein the maintenance unit is provided in an end portion area on a first direction side in a width direction, the width direction being a direction intersecting the depth direction, the liquid storage portion is provided in an end portion area on a second direction side, the second direction side being a side opposite the first direction side in the width direction, the liquid storage portion extending in the depth direction to an occupying area of the maintenance unit, the liquid container includes a first liquid storage area and a second liquid storage area, a height of the second liquid storage area being lower than that of the first liquid storage area, and the second liquid storage area extending in the depth direction to the occupying area of the maintenance unit, and a portion of the second liquid storage area is positioned below a reciprocating area of the carriage.

2. The recording apparatus according to claim 1, further comprising:

a pair of downstream rollers that are a pair of rollers first positioned, in the transport direction, downstream of a recording area where the recording unit performs recording, the pair of downstream rollers sending a medium, on which recording has been performed, downstream, wherein the liquid storage portion extends in the depth direction to a position on a rear side of the apparatus with respect to the pair of downstream rollers.

3. The recording apparatus according to claim 2, wherein the liquid storage portion extends in the depth direction to where the recording unit is positioned.

4. The recording apparatus according to claim 1, further comprising:

a housing that constitutes an outer shell of an apparatus body included in the recording unit, wherein the liquid storage portion includes a protruding portion that protrudes forwardly from a front surface of an end portion of the housing on the first direction side, and the liquid storage portion is configured to, at an upper portion of the protruding portion, expose a filling port through which a liquid is filled into the liquid container.

5. The recording apparatus according to claim 4, wherein the liquid storage portion includes a plurality of the liquid containers aligned in the width direction, and each of the plurality of liquid containers includes the filling port.

6. The recording apparatus according to claim 5, wherein one of the liquid container among the plurality of liquid containers is a liquid container that stores black ink, and the liquid container that stores the black ink is, among the plurality of liquid containers, positioned at an end portion on the second direction side.

7. The recording apparatus according to claim 6, wherein the liquid container that stores the black ink extends rearwardly in the depth direction with respect to the other liquid containers.

8. The recording apparatus according to claim 6, further comprising:

an upper structure above the housing, wherein the filling port included in the liquid container that stores the black ink and the filling ports included in the other liquid containers are disposed so as to be aligned in a linear manner in the width direction, and a distance between the filling port of the liquid container that stores the black ink and the upper structure is larger than distances between the filling ports included in the other liquid containers and the upper structure.

9. The recording apparatus according to claim 8, wherein the distance between the filling port of the liquid container that stores the black ink and the upper structure is set larger than the distances between the filling ports included in the other liquid containers and the upper structure by having a corner portion of a front surface of the upper structure on the second direction side have a beveled shape or a round shape.

10. The recording apparatus according to claim 8, wherein a lateral surface of the upper structure on the second direction side, a lateral surface of the housing on the second direction side, and a lateral surface of the liquid storage portion on the second direction side are flush with each other.

11. The recording apparatus according to claim 1, further comprising:

a medium transport path through which the medium is transported in a direction opposite a direction in which the medium is transported when recording is performed by the recording unit; and a medium inverting portion that inverts the medium, the medium having been transported through the medium transport path, towards the recording unit, wherein the liquid storage portion extends in the depth direction to an occupying area of the medium transport path.

* * * * *